US005630726A

United States Patent [19]

Baldwin

[11] Patent Number: 5,630,726

[45] Date of Patent: May 20, 1997

[54] LOCKING ELECTRICAL CORD

[76] Inventor: Christopher T. Baldwin, R.R. 1, Box 116, Clarkfield, Minn. 56233

[21] Appl. No.: 557,452

[22] Filed: Nov. 14, 1995

[51] Int. Cl.[6] ..... H01R 4/50

[52] U.S. Cl. ..... 439/346; 439/270

[58] Field of Search ..... 439/342, 345, 439/346, 332, 337, 269.2, 270, 848, 889, 620

[56] References Cited

U.S. PATENT DOCUMENTS 2,408,551 10/1946 Frank ..... 173/343
2,569,037 9/1951 Dalton ..... 173/330
4,925,396 5/1990 Grover ..... 439/346 X
5,286,213 2/1994 Altergott et al. ..... 439/346 X

*Primary Examiner*—Khiem Nguyen
*Attorney, Agent, or Firm*—Moore & Hansen

[57] ABSTRACT

A locking, non-catching electrical cord has smoothly rounded edges so as not to catch on foreign objects. The male prongs of the extension cord taper from the end of the cord to a rounded end of the same height, and the prong receptacles are shaped to fit the male prongs, so as to allow the prongs to snap-fit into the receptacles. Alternatively, the prong receptacles may have two cavities skewed from one another, and the male prong end of the cord may be twisted once situated within the prong receptacle to create a locking fit.

20 Claims, 1 Drawing Sheet

LOCKING ELECTRICAL CORD

BACKGROUND OF THE INVENTION

The present invention relates generally to the field of electrical cords. Specifically, it relates to electrical cords that lock to prevent disengagement, and do not catch on obstacles.

Use of the common extension cord is nearly universal. Extension cords come in all various lengths, colors and of varying size. Extension cords are used in many applications, from plugging in lamps to running power tools, and in all settings from household use to heavy construction.

In everyday use, it is common for extension cords to become separated from the wall outlet into which they are plugged, or become separated from the power cord of the device being used. When this happens, the user must plug the extension cord or device back in before continuing. In situations in which the cord pulls from a wall plug a distance from the area in which the user is working, the re-plugging of the cord can be an inconvenience. In construction situations especially, such an unplugging can be even more of an inconvenience. For example, construction work often involves working on a ladder, on a roof, or in an enclosed space, at some distance from the point at which the electrical cord is connected to power, or the tool is connected to an extension cord. When an electrical cord comes unplugged in such a situation, the user may have to climb down a ladder, off of a scaffold, or actually exit a structure in order to reconnect the cord. All of this results in lost time, as well as inconvenience.

In certain situations, re-plugging an extension cord in a construction setting is more than inconvenient. When removing asbestos, the person doing the removal, in order to leave the enclosure in which the removal is being performed, must shower out, that is take the time to completely remove any asbestos fibers that may be on his or her person, before leaving the enclosure. If an extension cord comes unplugged while working with power tools within an asbestos enclosure, considerable time will be lost in showering out simply to re-connect the cord. Further, occupational safety standards require ground fault circuit interrupters in asbestos removal sites. Typical add-on ground fault circuit interrupters are bulky and have a tendency to catch on corners and objects, leading to the unplugging of cards.

To combat the problem of extension cords pulling out of wall sockets and extension cords pulling loose from power cords of devices, users have come up with several ways to stop such occurrences. For example, it is fairly common for a user to tie a simple knot where the extension cord and another cord meet thereby isolating the joint between the two cords and preventing the cords from separating. Also, specially designed enclosures have been used which isolate the joint between two cords by placing the end pieces into a box or similar structure to prevent the pulling out of the cords.

Such attempts at maintaining the integrity of the connection have been successful in a limited way. Tieing a knot in an extension cord may have a tendency to, over time, weaken the cord to a point where the wires of the cord are broken and the cord becomes unusable. Further, the tieing of knots or the use of bulky enclosures creates the further problem of the cord catching on various objects, such as ladder rungs, door frames, wall corners, and the like. Even typical cords have sharp edges that catch on corners and objects. When this happens a severe jolt can be given to the device being used, the cord, or both. The cord, tool or device being used may suffer damage and further time may be lost in either replacing the cord or the tool.

Attempts have also been made at fashioning wall sockets and specialized plugs that will allow the locking of a cord into a wall outlet. However, these types of devices have generally required a number of moving parts and are generally incompatible with existing cords. Either a specialized cord is required or the modified outlet cannot accept normally configured cords.

Given the problems with the prior art, namely that the methods and devices used to hold cords together are bulky, potentially damaging to the cord, and easily catch on obstacles, causing potential trauma to the cord and tool used, there exists a need for a non-catching, locking electrical cord.

SUMMARY OF THE INVENTION

The present invention is a non-catching, locking electrical cord. The plugs of the cord as well as the receptacle of the cord are fully compatible with existing cords. No modification of existing cords will be needed in order to use the extension cord contemplated by the present invention. Such cords will not lock specially with the modifications of the present invention, but existing cords will be useable with a socket or other cords embodying the invention, and increased retention of traditional cords will also result.

The present invention may be used as a stand alone extension cord, or as modified wall socket in combination with an extension cord, or an add-on modification to an existing cord. Typical grounded electrical cords include a male end having two live or conductive prongs, one generally larger than the other for polarization, and a separate ground prong for maintaining proper electrical ground. Typical live prongs are rectangular in shape, and relatively flat, extending longitudinally from the end of the cord. The present invention modifies the existing live prongs by tapering the height of the prongs from the end adjacent the cord body toward the far end of the prong, ending with a rounded end head portion that makes the prong height at the end of each prong approximately equal to the prong height at the end adjacent the cord. The ground prong, typically circular in cross-section, is provided with a recess extending fully or partially around the circumference of the prong at a point near the end of the prong.

The receptacle or female end for the locking electrical cord has specially designed ground prong and live prong cavities to allow locking of the male prongs within the female cord end. The ground hole has a main cavity of a standard configuration for acceptance of traditional ground prongs. An upper cavity section is skewed from the main orientation of the ground cavity. A three-fourths ring of resilient rubber is situated in the ground hole upper cavity. This ting will snap-fit with the recess of the modified ground plug.

The live prong cavity has a lower cavity similar to traditional cavities. Metal extending knobs extend from each side of the lower cavity partially into the cavity approximately half the distance between the upper and lower ends of the cavity. An upper cavity is skewed from the main cavity. The upper cavity has a taper from its largest height of approximately half the height of the main cavity at the entrance or outer end of the female receptacle to a narrowest point approximately three-fourths of the distance into the upper cavity. The upper cavity terminates at its inner end with a semi-circular recess the height of which is preferably equal to the maximum height of the cavity. The top of the tapered section is lined with metal to facilitate contact between the live prongs and the upper cavity.

Alternatively, the live prong receptacles may have only one cavity section, sized and shaped to fit the modified live prongs. A metal contact is placed along the taper to prevent wear of the soft rubber and to facilitate a proper connection between the prong and the receptacle. When a plug is inserted into the receptacle, it will snap-fit into the receptacle.

The body of the non-catching electrical cord is made of soft, resilient rubber. The outer surface of the body of the cord is smooth with no ridges or corners which may catch on obstacles. The soft rubber construction of the body also serves to assist in friction fitting of the male plug into the female receptacle as well as the retention of traditional plugs within the modified female receptacle, since the resilient rubber may be partially displaced by the prongs, and its return force will serve to add extra friction to the fit.

When a traditional plug is inserted into the female receptacle of the present invention the extending metal knobs in the live prong lower cavities serve to help retain the live prongs in their proper position. The prongs displace the metal knobs, and the resilient force of the soft rubber is pushed against the knobs, helping to hold the prongs in place. When a male plug of the type disclosed by the present invention is inserted into the modified female receptacle, a simple twist will allow the ground prong recess to be engaged in a snap-fitted relation with the semi-circular ring of the modified ground hole, while the modified live prongs will seat into the upper cavity sections to retain the male plug in the female receptacle. The metal extending knobs in the main cavity sections will serve as a platform or base on which the bottom of the male prongs will rest. In this way, the male end of the locking cord is held in the female end of the cord and the joint is aligned so a smooth overall surface results. The ends may be released again with a twist of the cord. The smooth configuration of the main body of the plug housing will prevent the plug from catching on obstacles and thereby from damaging the cord and any devices used therewith.

A ground fault circuit interrupter may be placed within the smooth body of the locking electrical cord, so that the cord may be used in a wider variety of applications.

These and other benefits of the present invention will become apparent from the following detailed description thereof taken in conjunction with the accompanying drawings, wherein like reference numerals indicate like elements throughout the several views.

DESCRIPTION OF THE PREFERRED EMBODIMENTS

Figure 1:
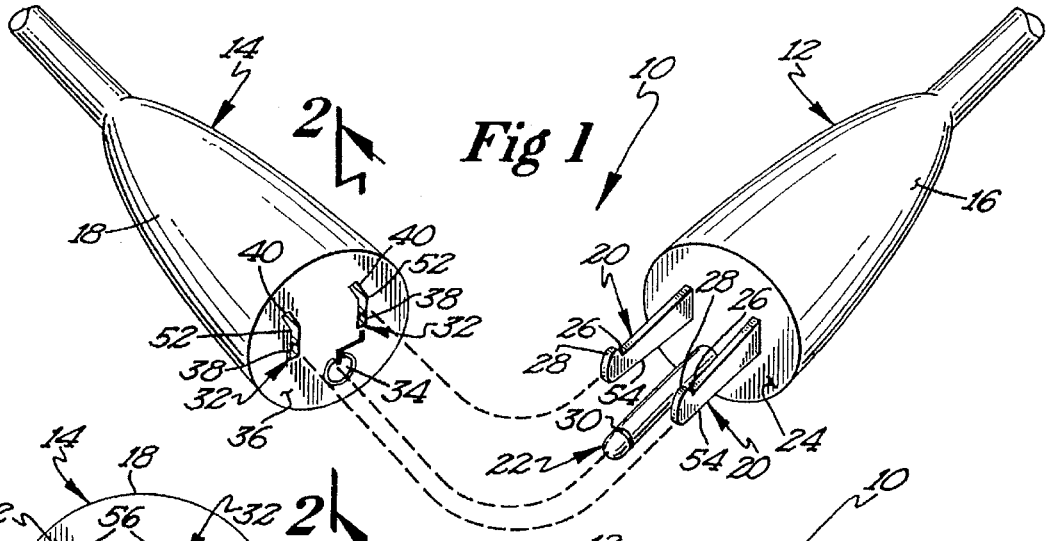
FIG. 1 is a perspective view of an embodiment of the non-catching, locking electrical cord.

Referring now to the drawings, the locking extension cord 10 may be seen in perspective in FIG. 1. The locking electrical cord 10 has male end 12 and female end 14. The body 16 of male end 12 is smooth, with no rough edges or corners that may catch on objects. Similarly, female end 14 has a smooth body 18 that is free from rough edges that may catch or tangle with other objects. Bodies 16 and 18 are made from soft resilient rubber. When ends 12 and 14 are joined, the resulting joint is smooth overall, with no rough edges or corners that will catch on objects.

Male end 12 has two extending live prongs 20 and a ground prong 22. Live prongs 20 are tapered from end 24 of male end 12, with their greatest height at end 24. Each male prong 20 tapers to a lesser or shorter height the further it gets from end 24, with the minimum height being at approximately three-quarters of the length of prong 20 from end 24, at point 26. The minimum height at point 26 may be approximately half the maximum height of prongs 20. End 28 of each male prong 20 is rounded to form a locking head, which is preferably the maximum height of the prong. Ground prong 22 is generally circular in cross-section. Approximately three-quarters of the distance away from end 24 of male end 12, ground prong 22 has a partial circumferential groove 30 extending approximately three-quarters of the way around the circumference of prong 22.

Female end 14 has corresponding live openings 32 and ground opening 34 at its end 36. End 36 of female end 14 may be seen best in FIG. 2. Live prong cavities 32 each have a lower cavity section 38 and an upper cavity section 40. Each upper cavity section 40 is skewed from its respective lower cavity section 38 at an angle of approximately forty-five degrees from vertical. The angular offset of upper cavity sections 40 is not essential. Due to the inter-locking action of the male and female ends 12 and 14 of the extension cord 10, the offset may be varied. The height of each lower cavity section 38 of cavities 32 is approximately equal to the height of a conventional corresponding live prong of a traditional extension cord or other electrical cord. This assures that the locking electrical cord 10 female end 14 is compatible with traditional existing plugs.

Figure 3:
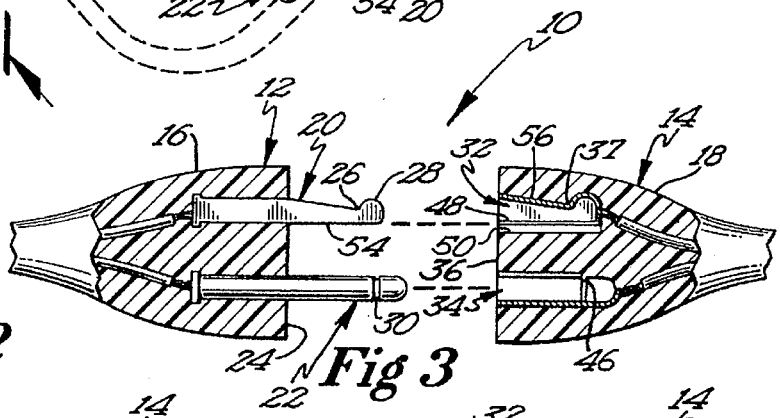
FIG. 3 is a side view of the male and female ends of the embodiment of FIG. 1, partially cut away to show the cavities.

Each cavity 32 is tapered along its upper cavity section 40 similarly to live prongs 20 of male end 12, as best shown in FIG. 3. Each upper cavity section 40 has its greatest height at end 36 of female end 14, and tapers to its minimum height at point 37. Minimum height points 26 and 37 of prongs 20 and cavities 32 correspond.

Ground cavity 34 has lower cavity section 42 and upper section 44, the cavity sections 42 and 44 also skewed as cavity sections 38 and 40 are skewed. Upper cavity section 44 has a soft rubber protrusion 46 extending along its outer walls. This extension 46 is an arcuate ridge of rubber situated in cavity 34 approximately three-quarters of the distance from end 36 of female end 14 to inner end of cavity 32. Protrusion 46 is designed to engage groove 30 of ground prong 22 in a snap-fit. Male and female ends 12 and 14 of locking electrical cord 10 are therefore designed to twist-lock together, creating a joint that does not easily separate.

Figure 2:
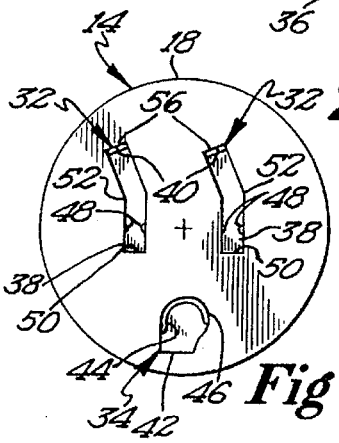
FIG. 2 is an end view of the female receptacle of the embodiment of FIG. 1.

Live prong cavities 32 each have elongated metal contact means in the form of metal ribs 48 approximately mid-way between the lower surface 50 of each live prong cavity 32 and the points 52 where upper and lower cavity sections 38 and 40 are skewed. These metal protrusions or ribs 48 extend substantially the length of cavities 32, and are placed one on each side of each cavity 32 as best shown in FIG. 2. Bodies 16 and 18 of locking electrical cord 10 are made of soft rubber. Therefore, the cavities 32 and 34 may frictionally as well as lockingly engage prongs inserted into the cavities. Metal protrusions 48 serve to engage the conventional live prongs of a traditional extension cord or a power cord in a friction fit, to help retain a traditional cord in the cavities 32 of locking electrical cord 10. When traditional live prongs are inserted into cavities 32 the ribs 48 grip and engage the live prongs, the resilience of the soft rubber bodies 16 and 18 causes ribs 48 to push against the prongs, retaining the plug in the cavities. Metal ribs 48 also serve as a base for modified live prongs 20 when male end 12 and female end 14 are twisted with respect to one another.

Figure 4:
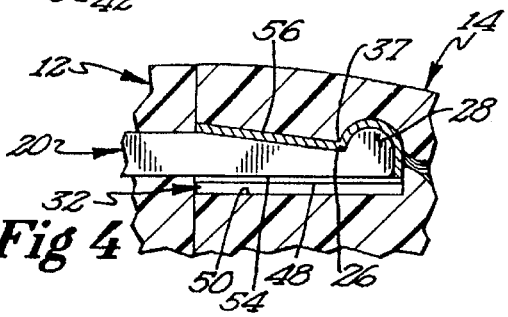
FIG. 4 is a side view of a live cavity and the positioning of a prong therein.

When male prongs 20 and modified ground prong 22 are inserted into cavities 32 and 34 respectively of female end 14, and male end 12 is twisted with respect to female end 14, the prongs move in cavities 32 to a tilted position in which metal extensions 48 serve as a base for the bottoms 54 of live prongs 20. When male end 12 is twisted with respect to female end 14, the bottoms 54 of the male prongs 20 move to rest on metal ribs 48 as best shown in FIG. 4. Since the upper cavity sections 40 are tapered similarly to live prongs 20, live prongs 20 are snap-fitted into cavities 32 to further assist in retention of male end 12 in female end 14.

Each upper cavity section 40 of cavities 32 is lined along its taper with a metal contact element 56. This metal contact element 56 serves to promote better contact between the cavities 32 and the prongs 20. Further, contact element 56 reduces the amount of wear on soft rubber body 18 of female end 14 when male end 12 is joined with female end 14 during normal operation. All cavities are also lined with material proper to create an appropriate electrical connection to the remainder of cord 10.

Figure 5:
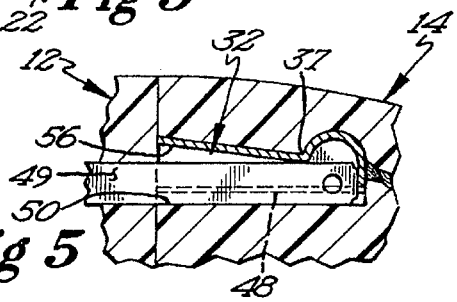
FIG. 5 is a side view of a traditional live prong positioned within a modified cavity.

Referring now to FIG. 4, the twisted or locked position of a live prong 20 within a cavity 32 is seen. When live prong 20 is seated in the upper half of the lower cavity section 38 and cavity section 40, the base 54 of prong 20 rests on extending metal ribs or protrusions 48. The positioning of a conventional prong 49 within cavity 32 is shown in FIG. 5.

Figure 6:
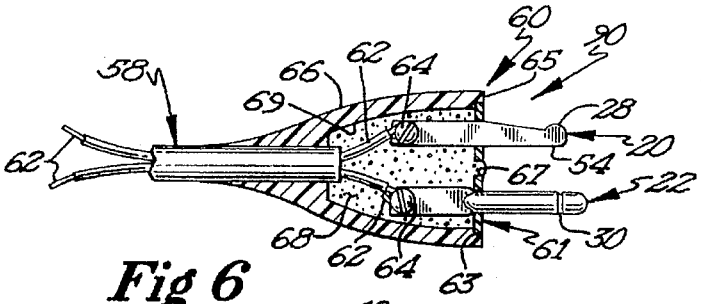
FIG. 6 is an alternative embodiment of the present invention including an add-on end to an existing electrical cord.

The female end 14 configuration for the locking electrical cord 10 may be used in a conventional wall outlet as well. Further, existing cords 58 may be converted into locking cords as shown in FIG. 6. An existing extension cord 58 may be adapted to become a locking electrical cord 90 by the use of an add-on male receptacle end 60. The conventional female end of traditional cord 58 is removed, and the appropriate wires 62 are connected to the appropriate leads 64 from add-on male receptacle 60. Female receptacle 60 includes faceplate 61 which carries prongs 20 and 22. A soft rubber shell 66 has a ledge 63 extending around its inner circumference at end 65. Faceplate 61 is sized to snap fit into soft rubber shell 66 at ledge 63. Faceplate 61 has an opening 67 through which a potting material 68 such as rapidly hardening silicon gel may be introduced into cavity 69. A soft rubber shell 66 of female receptacle 60 having a smooth configuration with no corners or rough edges to catch may then be slid over the female end receptacle 60 and traditional electrical cord 58 and attached thereto by the use of a rapidly hardening silicon gel 68 or the like. The soft rubber shell 66 and the faceplate 61 then snap together to form smooth surfaced female receptacle 60.

Figure 7:
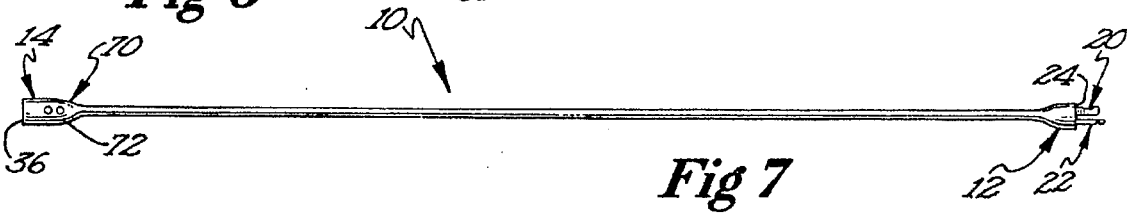
FIG. 7 is an alternative embodiment of the present invention including a non-catching ground fault circuit interrupter in the cord.

A ground fault circuit interrupter 70 may be incorporated into the locking electrical cord 10 (FIG. 7). A smooth soft rubber enclosure 72 will encompass ground fault circuit interrupter 70 so as to eliminate potential catching of the cord 10 and ground fault circuit interrupter 70 on objects. Preferably, ground fault circuit interrupter 70 is positioned within an end body 16 or 18 of the cord 10, to limit the likelihood of catching on foreign objects.

Figure 8:
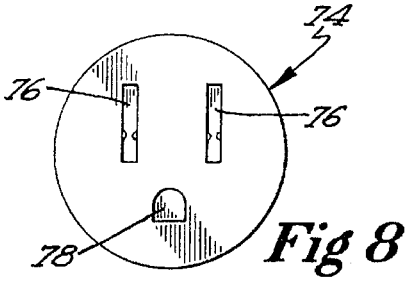
FIG. 8 is an end view of an alternative embodiment of the female end of a locking electrical cord.

Alternatively, as shown in FIG. 8, an alternative female receptacle end 74 may be used in which the live cavity 76 and ground cavity 78 include only one cavity section, and do not have sections skewed from one another. If designed in this manner, the cavities would still taper as shown in FIG. 3, but no twisting would be required to lock male end 12 within alternative female end 74.

The principles of the female end of the locking electrical cord 10 may also be used at a wall outlet, to create a locking wall outlet useable for traditional male ends of cords as well as locking male end of cords.

The detailed description outlined above is considered to be illustrative only of the principals of the invention. Numerous changes and modifications will occur to those skilled in the art, and there is not intention to restrict the scope of the invention to the detailed description. The preferred embodiments of the invention having been described in detail the scope of the invention should be defined by the following claims.

What is claimed:

1. A locking electrical cord, comprising:

a cord having a male end with two conductive prongs and a female end with two conductive prong receptacles;

said conductive prongs tapering from a maximum height at the male end to a lesser height at the remote end, and terminating in a rounded locking head at the remote end;

said conductive prong receptacles shaped to fit said male prongs, said receptacles tapering from a maximum height at the outer, entrance end to a lesser height at their inner ends, and terminating in an inner rounded recess adapted to tightly receive said locking head protrusion in snap-fit retention therewith.

2. A locking electrical cord as described in claim 1, wherein:

said male end further comprises a grounded prong; and said female end further comprises a ground prong receptacle.

3. A locking electrical cord as described in claim 2, wherein:

said grounded prong has a recess near its distal end, said recess extending approximately three-fourths of the way around the circumference of said prong; and said ground prong receptacle has a soft rubber protrusion designed to fit said ground prong recess, and help to hold said male end and said female end together.

4. A locking electrical cord as described in claim 1, wherein said male end and said female end are smooth with no rough or sharp edges.

5. A locking electrical cord as described in claim 1, wherein said male end and said female end are composed of soft resilient rubber.

6. A locking electrical cord as described in claim 1, and further comprising:

a ground fault circuit interrupter disposed between said male and said female ends, said ground fault circuit interrupter encased by said cord in a smooth enclosure with no sharp or rough edges.

7. A locking electrical cord as described in claim 6, wherein said ground fault circuit interrupter is enclosed within said male end.

8. A locking electrical cord as described in claim 6, wherein said ground fault circuit interrupter is enclosed within said female end.

9. A locking electrical cord as described in claim 1 wherein:

said lesser height at the remote end of the conductive prongs is approximately half said maximum height.

10. A locking electrical cord as described in claim 1 wherein:

said lesser height at the inner end of said prong receptacles is approximately three-fourths of said maximum height at the entrance end of said receptacles.

11. A locking electrical cord as described in claim 1 wherein:

elongated metal contact means are disposed within the tapered prong receptacles for frictional engagement with said conductive prongs on said male end or with the conductive prongs of a conventional power cord.

12. A locking electrical cord as described in claim 11 wherein:

said metal contact means comprise a pair of ribs extending along the inside wall surface of the prong receptacles in opposed relation to each other.

13. A locking electrical cord as described in claim 1 wherein:

said recess in the prong receptacles generally conforms to the shape of the locking head on the remote end of the conductive prongs.

14. A locking electrical cord, comprising:

a cord having a male end with two conductive prongs and a female end with two conductive prong receptacles;

said conductive prongs tapering from a maximum height at the male end to a lesser height and ending in a locking head;

each said conductive prong receptacle having a lower and an upper cavity section, said upper and said lower cavity sections skewed at an angle to each other; and said upper cavity section having an upper surface;

said upper cavity section lined on said upper surface with metal.

15. A locking electrical cord as described in claim 14, and further comprising:

a pair of extending metal ribs on said lower cavity section walls, extending inwardly into said cavity section, said extending ribs situated between the bottom and the top of said lower cavity section.

16. A locking electrical cord as described in claim 14, wherein:

said male end further comprises a grounded prong; and said female end further comprises a ground prong receptacle.

17. A locking electrical cord as described in claim 16, wherein:

said grounded prong has a circumferential recess near its distal end; and said ground prong receptacle has a soft rubber protrusion which engages said ground prong recess.

18. A locking electrical cord as described in claim 14, wherein said male end and said female end are composed of soft resilient rubber.

19. A locking electrical cord as described in claim 14, and further comprising:

a ground fault circuit interrupter disposed between said male and said female ends, said ground fault circuit interrupter encased by said cord in a smooth enclosure with no sharp or rough edges.

20. A locking electrical cord as described in claim 19, wherein said ground fault circuit interrupter is enclosed within said male end.

* * * * *